US007171784B2

(12) United States Patent
Eenigenburg

(10) Patent No.: US 7,171,784 B2
(45) Date of Patent: Feb. 6, 2007

(54) TILT-LATCH FOR A SASH WINDOW

(75) Inventor: Mark B. Eenigenburg, Lansing, IL (US)

(73) Assignee: Newell Operating Company, Atlanta, GA (US)

( * ) Notice: Subject to any disclaimer, the term of this patent is extended or adjusted under 35 U.S.C. 154(b) by 262 days.

(21) Appl. No.: 10/411,881

(22) Filed: Apr. 10, 2003

(65) Prior Publication Data

US 2004/0074146 A1 Apr. 22, 2004

Related U.S. Application Data

(60) Provisional application No. 60/371,973, filed on Apr. 12, 2002.

(51) Int. Cl.
*E05D 15/22* (2006.01)

(52) U.S. Cl. ..... 49/181; 49/445

(58) Field of Classification Search ..... 49/181, 49/183, 180, 445, 446, 184, 185, 449; 292/175, 292/DIG. 47, DIG. 337
See application file for complete search history.

(56) References Cited

U.S. PATENT DOCUMENTS

| | | | |
|---|---|---|---|
| 16,228 | A | 12/1856 | Copeland |
| 1,781,729 | A | 11/1930 | Major |
| 2,568,273 | A | 9/1951 | Clark |
| 2,965,935 | A | 12/1960 | Olsen |
| 3,080,621 | A | 3/1963 | Mendelsohn |
| 3,122,797 | A | 3/1964 | Segre |
| 3,841,674 | A | 10/1974 | Bisbing et al. |
| 3,850,464 | A | 11/1974 | Bisbing et al. |
| 4,167,835 | A | 9/1979 | Nobes et al. |
| 4,400,026 | A | 8/1983 | Brown, Jr. |
| 4,475,311 | A | 10/1984 | Gibson |
| 4,482,178 | A | 11/1984 | Damiana |
| 4,553,353 | A | 11/1985 | Simpson |
| 4,578,903 | A | 4/1986 | Simpson |
| 4,581,850 | A | 4/1986 | Simpson |
| 4,622,778 | A | 11/1986 | Simpson |
| 4,669,765 | A | 6/1987 | Ullman |
| 4,790,579 | A | 12/1988 | Maxwell et al. |
| 4,791,756 | A | 12/1988 | Simpson |
| 4,824,154 | A | 4/1989 | Simpson |
| 4,837,975 | A | 6/1989 | Simpson |
| 4,901,475 | A | 2/1990 | Simpson |

(Continued)

*Primary Examiner*—Naoko Slack
*Assistant Examiner*—Chi Q. Nguyen
(74) *Attorney, Agent, or Firm*—Banner & Witcoff, Ltd.

(57) ABSTRACT

A tilt-latch (10) for a sash window (12) disposed within opposed guide rails (16) on a master frame (14) is provided. The sash window (12) comprises a top rail (18), a base (22) and two stiles (24, 26) connected together at their extremities. The tilt-latch (10) is adapted for releaseably securing the sash window (12) to the master frame (14). The tilt-latch (10) includes a housing (30) adapted to be supported by the top rail (18), the housing (30) having an outward end opening (54). The tilt-latch (10) further includes a latch bolt (32) disposed within the housing (30) and having a nose (56) adapted for engaging a respective one of the guide rails (16). The latch bolt (32) has structure wherein the latch bolt (32) is capable of being operably positioned in the housing (30) in one of a first position for a right-hand tilt-latch (10) and second position for a left-hand tilt-latch (10).

51 Claims, 5 Drawing Sheets

U.S. PATENT DOCUMENTS

| | | | |
|---|---|---|---|
| 4,917,413 | A | 4/1990 | Jason et al. |
| 5,028,083 | A | 7/1991 | Mischenko |
| 5,068,932 | A | 12/1991 | Chang |
| 5,096,240 | A | 3/1992 | Schultz |
| 5,121,951 | A | 6/1992 | Harbom et al. |
| 5,121,952 | A | 6/1992 | Jason |
| 5,127,685 | A | 7/1992 | Dallaire et al. |
| 5,139,291 | A | 8/1992 | Schultz |
| 5,145,221 | A | 9/1992 | Pennebaker et al. |
| 5,165,737 | A | 11/1992 | Riegelman |
| 5,465,191 | A | 11/1995 | Nomura et al. |
| 5,618,067 | A | 4/1997 | Carlson et al. |
| 5,669,180 | A | 9/1997 | Maier |
| 5,669,639 | A | 9/1997 | Lawrence |
| 5,671,958 | A | 9/1997 | Szapucki et al. |
| 5,806,900 | A | 9/1998 | Bratcher et al. |
| 5,829,196 | A | 11/1998 | Maier |
| 5,927,013 | A | 7/1999 | Slocomb et al. |
| 5,970,656 | A | 10/1999 | Maier |
| 5,996,283 | A | 12/1999 | Maier |
| 6,021,603 | A | 2/2000 | Prete et al. |
| 6,155,615 | A | 12/2000 | Schultz |
| 6,178,696 | B1 | 1/2001 | Liang |
| 6,183,024 | B1 | 2/2001 | Schultz et al. |
| 6,230,443 | B1 | 5/2001 | Schultz |
| 6,340,183 | B1 | 1/2002 | Ramsauer |
| 6,565,133 | B1 * | 5/2003 | Timothy ..... 292/242 |
| 6,604,324 | B1 * | 8/2003 | Maier ..... 49/181 |
| 6,874,826 | B1 * | 4/2005 | Polowinczak et al. ..... 292/175 |
| 2003/0047948 | A1 * | 3/2003 | Polowinczak et al. ..... 292/36 |

* cited by examiner

TILT-LATCH FOR A SASH WINDOW

RELATED APPLICATION

This non-provisional application claims the benefit of U.S. Provisional Application No. 60/371,973, filed on Apr. 12, 2002 which is expressly incorporated by reference herein and made a part hereof.

TECHNICAL FIELD

The present invention relates to a tilt-latch assembly for a pivotal sash window assembly and, more particularly to an interchangeable or reversible bolt for a tilt-latch assembly.

BACKGROUND OF THE INVENTION

A pivotal sash window adapted for installation within a master frame of a sash window assembly is well-known. The master frame assembly typically has opposed, vertically extending guide rails to enable vertical reciprocal sliding movement of the sash window in the master frame while cooperatively engaged with the guide rails. The sash window has a top sash rail, a base and a pair of stiles cooperatively connected together at adjacent extremities thereof to form a sash frame, usually a rectangular frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. The latch bolt has an actuator structure to allow for actuation of the latch bolt. The actuator structure is typically a small control button that is connected to the latch bolt. The actuator is typically finger-actuated wherein the latch bolt is retracted into the housing. This releases the latch bolt from the guide rail. When the latch bolts of the opposed tilt-latches are actuated simultaneously, the sash window can then be pivoted from the master frame.

The end or nose of the latch bolt extending through the outward end opening is generally comprised of an incline surface and a normal surface. The latch bolt is oriented within the housing so that the inclined surface is positioned to be acted on by the guide rails as the sash is tilted into the master frame. That is, the incline surface of each latch bolt generally faces the master frame as the sash is being tilted into the master frame. The engagement between the incline surface and the guide rail of the master frame forces the latch bolt into the housing. Once the sash is fully tilted into the master frame, the latch bolt extends into the guide rail wherein the normal surface engages the master frame to prevent the sash window from tilting. The sash window can ride along the guide rail as the sash window slides within the master frame.

Because of the required orientation of the latch bolt incline surfaces, each sash window typically requires separately constructed right-hand and left-hand tilt-latches. Specifically, separate right-hand and left-hand latch bolts are required. This increases the required tooling and inventories for tilt-latch manufacturers and inventories for tilt-latch purchasers including window manufacturers.

Also, previously known tilt-latches have been required to be shipped to window manufactures unassembled requiring sometimes complicated and time consuming in-field assembly. Shipping each tilt-latch in this manner also has the disadvantages and increased costs associated with an increased risk of loss or damage to individual tilt-latch components.

The present invention is provided to solve these and other problems.

SUMMARY OF THE INVENTION

The present invention provides a tilt-latch adapted for releasably securing a pivotable sash window to a master frame of a sash window assembly.

The master frame has opposed, vertically extending guide rails. The sash window has a top sash rail, a base and a pair of stiles cooperatively connected together at adjacent extremities to form a frame. The top sash rail includes a pair of opposing header slots. Each of the header slots forms a pair of opposing, longitudinal header rails.

The tilt-latch can be secured to the top sash rail by fasteners when the tilt-latch is fully assembled. The tilt-latch also has an interchangeable latch bolt wherein the same latch bolt can be installed and operable on the left side or right side of the sash window.

In one aspect of the invention, a tilt-latch is provided for a sash window disposed within opposed guide rails on a master frame. The sash window has a top rail, a base and two stiles connected together at their extremities. The tilt-latch is adapted for releaseably securing the sash window to the master frame. The tilt-latch has a housing adapted to be supported by the top rail, the housing having an outward end opening. The tilt-latch further has a latch bolt disposed within the housing, the latch bolt having a nose adapted for engaging a respective one of the guide rails, and further having structure wherein the latch bolt is capable of being operably positioned in the housing in one of a first position for a right-hand tilt-latch and second position for a left-hand tilt-latch.

In another aspect of the invention, the tilt-latch further has an actuator connected to the latch bolt when the latch bolt is positioned in one of the first position and the second position.

In another aspect of the invention, the latch bolt is substantially symmetrical about a plane occupying a longitudinal axis of the latch bolt.

In another aspect of the invention, the structure of the latch bolt comprises a latch bolt body that is substantially symmetrical about a plane occupying a longitudinal axis of the latch bolt.

In another aspect of the invention, the latch bolt has a height and the plane is generally proximate a midpoint of the height.

In another aspect of the invention, the plane is generally parallel to a second plane generally defined by a cover of the housing.

In another aspect of the invention, the plane is generally perpendicular to a second plane generally defined by a cover of the housing.

In another aspect of the invention, the nose has an incline surface.

In another aspect of the invention, the orientation of the incline surface of the latch bolt when in the first position is generally opposite to the orientation of the incline surface of the latch bolt when in the second position.

In another aspect of the invention, the latch bolt is orientated in the first position for a right-hand latch, wherein the tilt-latch is adapted to be supported proximate a right-hand side of the top rail wherein the incline surface is adapted to impact the guide rail.

In another aspect of the invention, the latch bolt is orientated in the second position for a left-hand latch, wherein the tilt-latch is adapted to be supported proximate a left-hand side of the top rail wherein the incline surface is adapted to impact the guide rail.

In another aspect of the invention, the tilt-latch further has means for biasing the latch bolt through the outward opening.

In another aspect of the invention, the biasing means comprises a spring having one end engaging the housing and another end engaging the latch bolt.

In another aspect of the invention, the latch bolt further has a spring post generally opposed to the nose, the spring being mounted to the spring post.

In another aspect of the invention, the housing further has a bottom wall defining a fastener hole adapted for receiving a fastener for securing the bottom wall to the top rail and wherein a slot of the latch bolt is generally aligned with the fastener hole.

In another aspect of the invention, the latch bolt has a height and further comprises actuator connecting structure proximate a midpoint of the height and the actuator comprises a depending post for releasably engaging the connecting structure.

In another aspect of the invention, the actuator connecting structure comprises a rail and the depending post comprises a lip for engaging the rail.

In another aspect of the invention, the actuator connecting structure comprises a pair of opposed rails and the post comprises a pair of lips for engaging a respective rail.

In another aspect of the invention, the actuator connecting structure further comprises a pair of opposed fingers and the post comprises pair of recesses for engaging a respective finger.

In another aspect of the invention, the actuator connecting structure comprises a protrusion and the post comprises a depression for releasably engaging the protrusion.

In another aspect of the invention, the tilt-latch has a tab that extends from the housing, the tab engaging the latch bolt in an extended position.

Other features and advantages of the invention will be apparent from the following specification taken in conjunction with the following drawings.

DETAILED DESCRIPTION OF THE INVENTION

Figure 1:
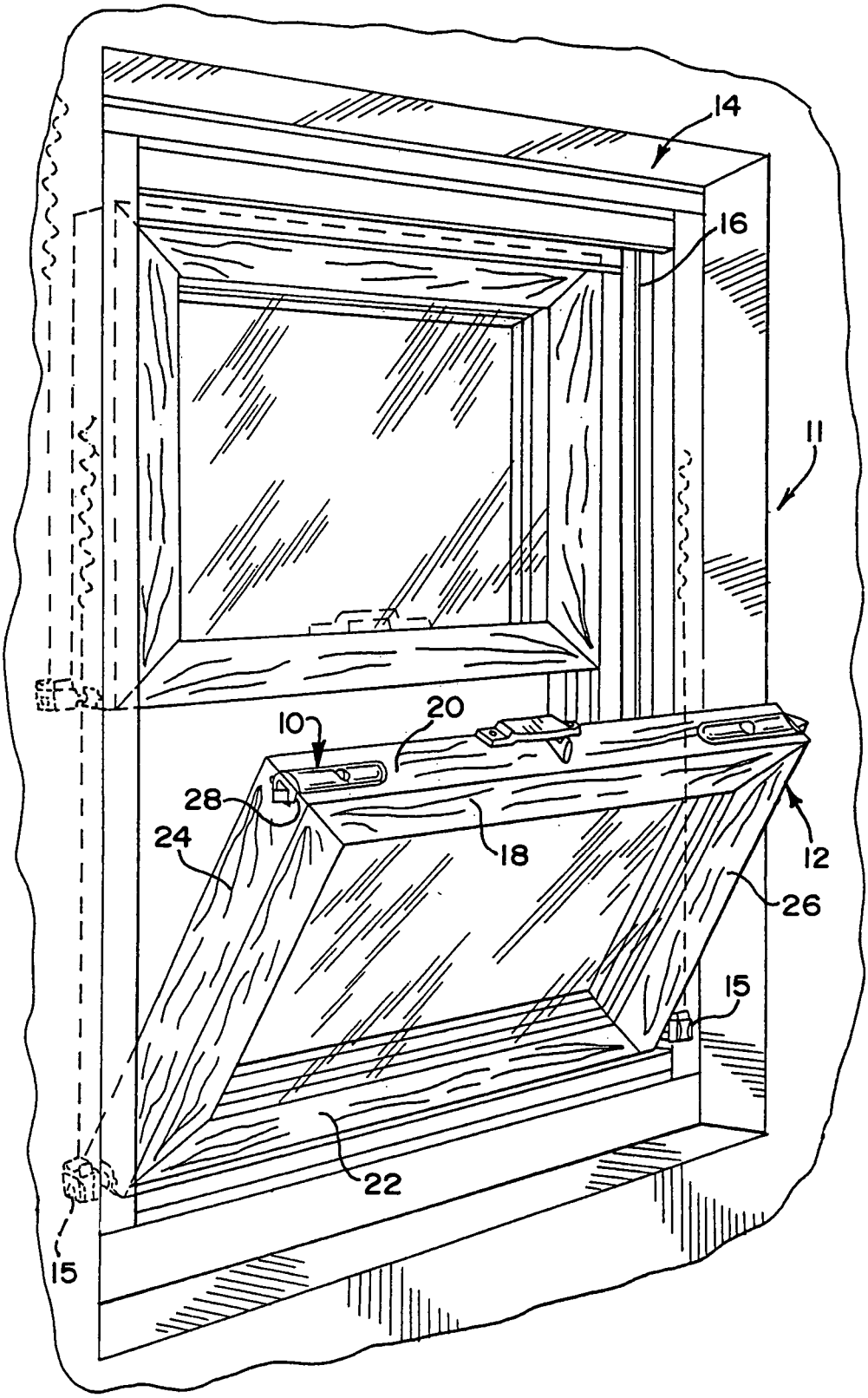
FIG. 1 is a perspective view of a double-hung sash window assembly utilizing tilt-latches according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a tilt-latch of the present invention, generally designated with the reference numeral 10, used in a sash window assembly 11. The sash window assembly 11 shown in FIG. 1 is a double-hung window assembly having a pivotal sash window 12 installed in a master frame 14. The particular sash window assembly 11 shown in FIG. 1 is made from wood although it could also be made from other materials. The tilt-latch 10 can be used in all types of pivotal windows or other structures. The sash window 12 is pivotally mounted to the master frame 14 by a sash balance/brake shoe assembly 15. As is well known, the master frame 14 has opposed, vertically extending guide rails 16. The sash window 12 has a top sash rail 18 having a top surface 20, a base 22 and a pair of stiles 24, 26, cooperatively connected together at adjacent extremities thereof to form a sash frame. The sash frame is typically rectangular although other shapes are possible.

Figure 6:
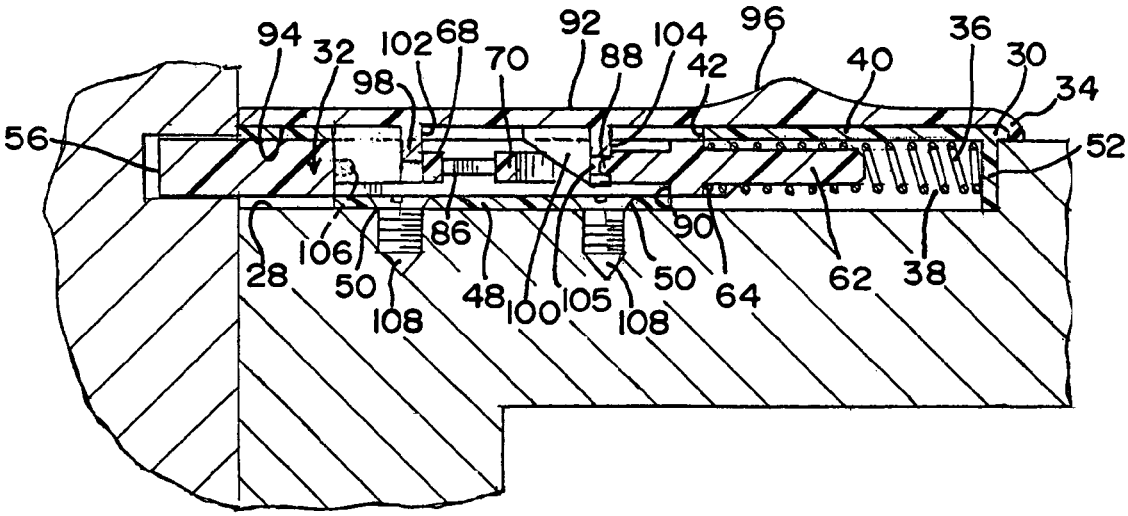
FIG. 6 is a cross sectional view of a left-hand tilt-latch installed in a top rail of a sash window with the latch bolt in an extended position.
Figure 7:
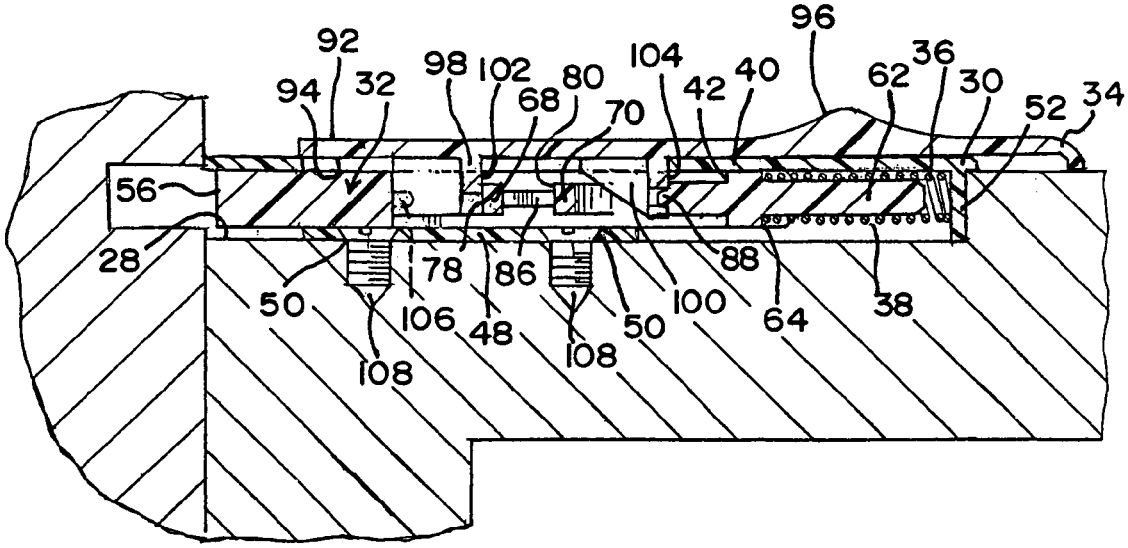
FIG. 7 is a cross sectional view of the tilt-latch of FIG. 6 with the latch bolt in a retracted position.

As mentioned, in one preferred embodiment, the sash frame is made from solid wood. The sash frame could also be made from simulated wood materials. Other solid structures are also possible such as masonite or pressboard. The sash frame could also be made from extrusions or pulltrusions that are filled with fiberglass, epoxy, plastic, or wood chips. If desired, the sash frame could also be hollow such as when made from PVC extrusions. As shown in FIGS. 1, 6 & 7, the top sash rail 18 includes a pair of opposing header slots 28, which are formed such as by routing the top sash rail 18. The top sash rail 18 could also be punch-routed. In applications where the top sash rail 18 is a hollow extrusion, the header slots 28 may be formed by prepunching the top sash rail 18.

As shown in FIGS. 2–7, the tilt-latch 10 generally comprises a housing 30, a latch bolt 32, an actuator 34 and a spring 36. As shown in FIGS. 1, 6 and 7, the housing 30 is adapted to be supported by the top rail 18. In a preferred embodiment, the housing 30 is designed to be flush-mounted in the top rail 18. It is understood, however, that the housing 30 could be designed to be supported in other ways by the top rail 18 such as a "top-mount" design as known in the art. The latch bolt 32 is disposed within the housing 30. The actuator 34 is connected to the latch bolt 32 and is designed to retract the latch bolt 32 into the housing 30 against the biasing force of the spring 36. It is understood that in a preferred embodiment, the actuator 34 is a separate component of the tilt-latch 10 but, nevertheless, could be integrally connected, for example, to the latch bolt 32.

Figure 3:
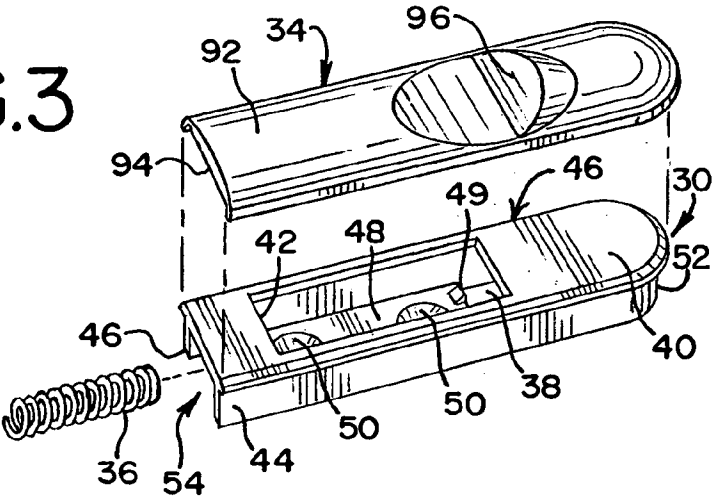
FIG. 3 is an exploded isometric view of the tilt-latch with the latch bolt oriented for use as a left-hand tilt-latch.
Figure 2:
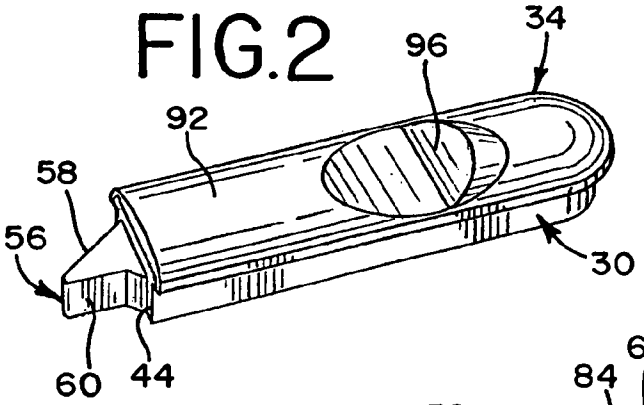
FIG. 2 is a perspective view of a tilt-latch according to the invention.

As shown in FIGS. 2 & 3, the housing 30 generally has a box-type structure defining a chamber 38 therein. The housing 30 has a cover 40 having an elongated opening 42 therein. A pair of sidewalls 44, 46 depend from the cover 40. The housing 30 further has a bottom wall 48 with a pair of fastener holes 50 adapted to receive a screw or other fastener as described further, below. The bottom wall 48 has a pair of stop tabs 49 extending therefrom. If desired, the tilt-latch 10 could be designed wherein the housing 30 has an open bottom end with no bottom wall 48, yet having appropriate structure for retaining the latch bolt 32 in the housing 30. The cover 40, sidewalls 44, 46 and bottom wall 48 cooperate to form the chamber 38 within the housing 30. The housing 30 and chamber 38 define a generally rectangular cross section. Where the housing 30 does not include a bottom wall 48, the chamber 38 is defined by the cover 40 and side walls 44, 48. Additionally, the housing 30 has a curved back wall 52, although one is not required. The housing 30 also has an outward end opening 54 in communication with the chamber 38.

The housing 30 is preferably of a one-piece construction. The one-piece construction strengthens the housing 30 and simplifies assembly. The housing 30, however, could also be made from multiple pieces. In addition, while a box-type housing 30 structure is preferred, the housing could also take other forms. For example, where the housing 30 does not include the bottom wall 48, it could include tabs to hold the latch bolt 32 in the housing 30. In a preferred embodiment of the invention, the housing is made from polymeric materials such as plastic using known injection molding processes. It is understood that any number of known plastic materials could be used. In a preferred embodiment, the housing is made from nylon plastic.

As shown in FIGS. 2–8, the latch bolt 32 is disposed within the chamber 38 of the housing 30 and is adapted to slide within the housing 30. The latch bolt 32 has a nose 56 and a bolt body 57. The nose 56 is adapted for engaging a respective one of the guide rails 16. The nose 56 includes an inclined surface 58 and a generally normal surface 60. It is understood that the nose 56 could omit the inclined surface 58 and thus have a normal end surface. Opposed from the nose 56 is a spring post 62 extending generally along a longitudinal axis of the latch bolt 32 and away from a rear or spring surface 64 of the latch bolt 32. It is noted that it is not necessary for the nose 56 to include an incline surface 58 to remain within the scope of this invention.

Figure 4:
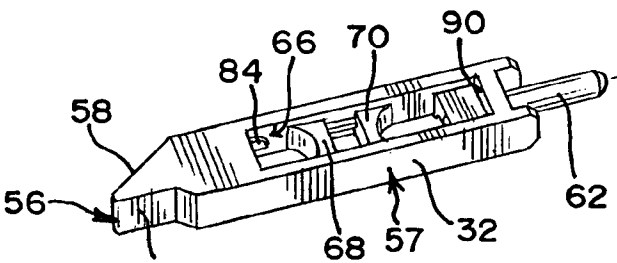
FIG. 4 is a top plan view of a latch bolt of the invention.
Figure 4:
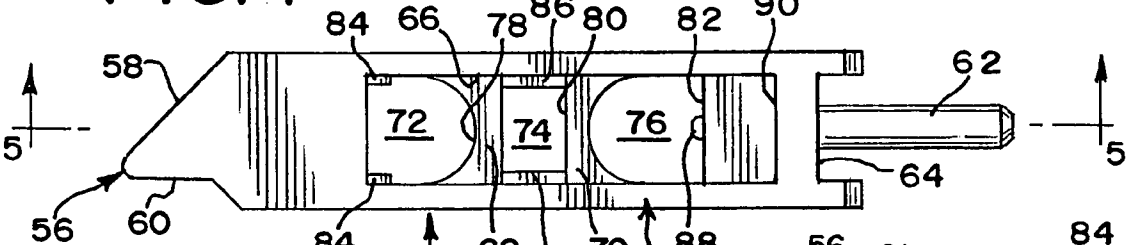
Figure 8:
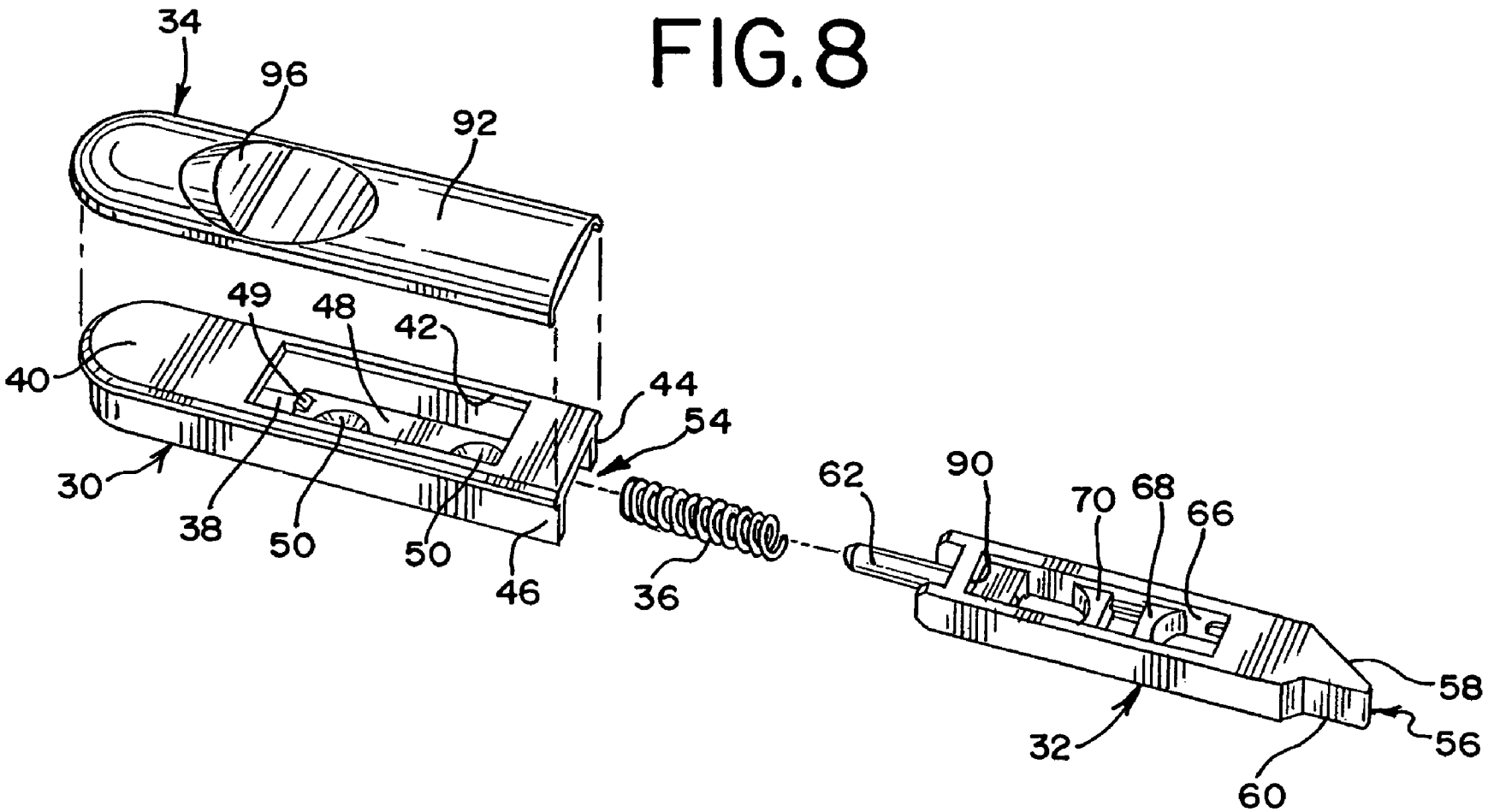
FIG. 8 is an exploded view of a tilt-latch with the latch bolt oriented for use as a right-hand tilt-latch.

As shown in FIGS. 3 & 4, the latch bolt 32 also includes a longitudinal slot or aperture 66. A front cross bar 68 and an rear cross bar 70 are positioned in the slot 66. The cross bars 68, 70 define a front aperture 72, a medial aperture 74 and an rear aperture 76, each within the slot 66. The front aperture 72 includes and defines a front bolt surface 78. The medial aperture 74 includes and defines a medial bolt surface 80. The rear aperture 76 includes and defines an rear bolt surface 82. A pair of fingers 84 extend into the front aperture 72. A pair of rails 86 extend into the medial aperture 74 and a protrusion 88 extends into the rear aperture 76. The slot 66 also defines a pair of stop surfaces 90 (FIGS. 3 & 8). The slot 66 and the connecting structure disposed therein, comprising the front cross bar 68, the rear cross bar 70, the fingers 84, the rails 86 and the protrusion 88, are adapted to cooperate with corresponding actuator connecting structure of the actuator 34, as described below.

Figure 5:
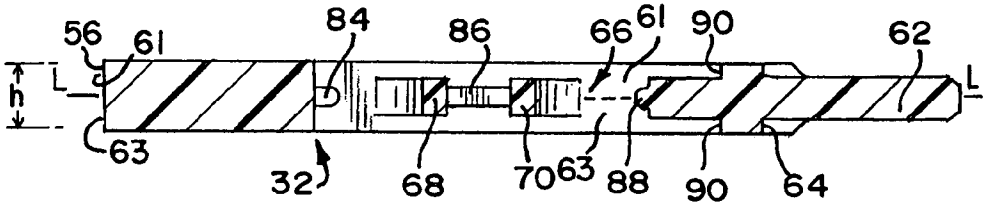
FIG. 5 is a cross-sectional view of the latch bolt along the line 5—5 shown in FIG. 4.

As seen in FIGS. 4–5, the front cross bar 68 and the rear cross bar 70 are of laterally symmetrical shape. That is, they are symmetrical about the plane including the longitudinal axis L of the latch bolt 32 which generally lies along the line 5-5 shown in FIG. 4, the plane also being generally normal to the cover 40 when the bolt 32 is positioned within the housing as shown in FIG. 3. Additionally, and as can be seen in FIG. 5, the front cross bar 68, the rear cross bar 70, the fingers 84, the rails 86 and the protrusion 88 are symmetrical about the longitudinal axis of the latch bolt 32 along a height 'h' (FIG. 5). The fingers 84, and the rails 86, are centrally located along the height 'h' of the latch bolt 32. As with the housing 30, the latch bolt 32 is also preferably made from plastic although other materials are possible. In a most preferred embodiment, the latch bolt 32 is made from nylon plastic.

As can be seen, the perimeter or outer structure of the bolt body 57 has a generally box-like shape to correspond to the box-like shape of the housing 30 and its chamber 38. Additionally, the bolt body 57 is generally laterally symmetrical, as discussed above. The bolt body 57 is also symmetrical in the direction 'h' (FIG. 5) about a plane including the longitudinal axis 5—5. That is, a first portion 61 of the outer structure of the bolt body 57 above this plane is generally symmetrical to, or a mirror image of a second portion 63 of the outer structure of the bolt body 57 below this plane. In the embodiments shown, all structures of the latch bolt 32 are similarly symmetrical. The significance of these features will be discussed below.

As shown in FIGS. 2, 3 and 6–8, the actuator 34 is generally an elongated body having an upper surface 92 and an underside surface 94. A control button 96 extends from the upper surface 92 and is shaped to be engaged by an operator's finger. In one preferred embodiment, the actuator 34 is shaped to correspond to the overall shape of the housing 30 so that the actuator 34 completely covers the housing 30 when connected to the latch.

As seen in FIGS. 6 & 7, depending from the underside surface 94 is a first post 98 having a first actuating surface 102. Also depending from the underside surface 94 is a second post 100 having a second actuating surface 104 with a depression 105 therein. The first post 98 is shaped to correspond to the shape of the front aperture 72 and to fit snugly therein. The first post 98 has a pair of recesses 106 on an outer surface of the first post 98. The recesses 106 are adapted to receive the fingers 84 and the depression 105 is adapted to receive the protrusion 88 when actuator 34 is connected to the latch bolt 32, to be explained further. As with the housing 30 and the latch bolt 32, the actuator is also preferably made from plastic although other materials are possible. In one preferred embodiment, the latch bolt 32 is made from nylon plastic. However, for applications wherein the tilt-latch 10 is being used with a wood sash, the actuator 34 may be made from a metal, such as zinc, for aesthetic or other purposes.

In a preferred embodiment of the invention, as shown, the spring 36 is a coil spring. The spring 36 is sized to be mounted to the spring post 62 and abut against the rear spring surface 64 of the latch bolt 32, as to be further described. It is understood, however, that other biasing members could also be used in place of the spring 36. For example, other types of springs can be used such as z-springs and leaf springs although coil springs are preferred. Rubber or polymeric resilient members could also be used. In addition, resilient plastic member(s) could be integrally attached to the latch bolt 32 to bias the latch bolt 32 out of the housing 30. In sum, any structure could be used that will bias the latch bolt 32 through the outward end opening 54. It is further understood that a biasing means is not required. The tilt-latch could be adapted for manual retraction and extension of the latch bolt 32.

The tilt-latch 10 can also be easily preassembled. The spring 36 is slipped over the spring post 62 and the latch bolt 32 and spring 36 are inserted into the chamber 38 of the housing 30 through the outward end opening 54, in an orientation as shown in FIG. 3. It is at this point that the proper orientation of the latch bolt 32 is selected. That is, the latch bolt 32 may be inserted into the housing 30 in an orientation shown in FIG. 3, or after rotating the latch bolt 180 degrees to an orientation shown in FIG. 8. The latch bolt 32 is then inserted into the chamber 38 until a stop surface 90 moves past the stop tabs 49. At this point the stop tabs 49 interferingly engage the stop surface 90 to maintain the latch bolt 32 within the chamber 38. The latch bolt 32 is slidable between an extended position, as shown in FIGS. 2 & 6, and a retracted position, as shown in FIG. 7. The spring 36 also abuts the back wall 52 of the housing 30 to bias the latch bolt 32 to the extended position.

Once the latch bolt 32 has been properly assembled within the housing 30, the actuator 34 is connected to the latch bolt 32 through the opening 42 in the cover 40 of the housing 30. The first post 98 and the second post 100 are inserted, respectively, into the front aperture 72 and rear aperture 76, through the opening 42 in the cover 40. The recesses 106 snappingly receive the fingers 84 and the depression 105 snappingly receives the protrusion 88 to maintain the connection between the actuator 34 and the latch bolt 32. The first actuating surface 102 opposes the front bolt surface 78 and the second actuating surface 104 opposes the rear bolt surface 82.

The assembled tilt-latch 10 can then be shipped completely preassembled. To install the tilt-latch 10, into a top rail 18, the actuator can be removed from the latch bolt 32. The housing 30 with latch bolt 32 and spring 36 is then inserted into the appropriate header slot 28. A screw 108 or other known fastener is inserted into one of the fastener holes 50 through the front aperture 72 and fastened to the top sash 18. Then the latch bolt 32 is slightly retracted, if necessary, to allow a screw 108 or other fastener to be inserted into the other fastener hole 50 through the rear aperture 76 and secured to the top rail 18. The actuator 34 may then be reconnected to the latch bolt 32 as previously described.

It is noted that the present invention eliminates the need for window manufacturers to anticipate, order and maintain separate right-hand and left-hand tilt-latch inventories. Window manufactures can order individual latches 10 and receive the unassembled tilt latch components. In this case, the window manufacturer will assemble the tilt-latch 10. That is, the manufacturer will slip the spring 36 over the spring post 62 and insert the latch bolt 32 and spring 36 into the chamber 38 of the housing 30 through the outward end opening 54. As described above, it is just prior to this point that the manufacturer selects the desired orientation of the latch bolt 32. That is, the latch bolt 32 may be inserted into the housing 30 in an orientation shown in FIG. 3 (for a left-handed tilt-latch), or after rotating the latch bolt 180 degrees to an orientation shown in FIG. 8 (for a right-handed tilt-latch). The latch bolt 32 is then inserted into the chamber 38 until the stop surface 90 moves past the stop tabs 49. At this point the stop tabs 49 interferingly engage the stop surface 90 to maintain the latch bolt 32 within the chamber 38.

The manufacturer then inserts the housing 30 with the latch bolt 32 and the spring 36 into the appropriate header slot 28. A screw 108 or other known fastener is inserted into one of the fastener holes 50 through the front aperture 72 and fastened to the top sash 18. Then the latch bolt 32 is slightly retracted, if needed, to allow a screw 108 or other fastener to be inserted into the other fastener hole 50 through the rear aperture 76 and secured to the top rail 18. The manufacturer then connects the actuator 34 to the latch bolt 32 through the opening 42 in the cover 40 of the housing 30. The first post 98 and the second post 100 are inserted, respectively, into the front aperture 72 and rear aperture 76, through the opening 42 in the cover 40. The recesses 106 snappingly receive the fingers 84 and the depression 105 snappingly receives the protrusion 88 to maintain the connection between the actuator 34 and the latch bolt 32. The first actuating surface 102 opposes the front bolt surface 78 and the second actuating surface 104 opposes the rear bolt surface 82. In this way, the manufacturer also avoids the need to remove the actuator 34 prior to installing the tilt-latch 10 into the top sash rail 18. Also, for each tilt-latch 10, the orientation of the latch bolt 32 in the housing 30 does not need to be made until just prior to installation, therefore simplifying inventory and manufacturing logistics.

Alternatively, each individual part of the tilt-latch 10 can be ordered and stocked separately by the manufacturer. In such a case, the manufacturer would assemble individual tilt-latches 10 using parts taken from their inventory, rather from a separately shipped package containing parts for a single tilt-latch. In other words, the manufacture can separately order housings 30, latch bolts 32, actuators 34 and springs 36. The manner of assembly of tilt-latches 10 from these parts will be identical to the assembly described immediately above.

In operation, an operator engages the control button 96 with a finger to slide the actuator 34 in a direction opposite or away from the nose 56. This moves the latch bolt 32 from its extended position (as shown in FIG. 6) to a retracted position (as shown in FIG. 7). Upon release of the control button 96 by the operator, the spring 36 returns the latch bolt 32 to its extended position.

FIGS. 2–3 & 6–7 show the tilt-latch 10 configured as a left-hand tilt-latch 10. That is, it is configured to be the tilt-latch 10 located at the upper left-hand corner of the sash window 12, as viewed by one about to actuate the tilt-latch 10 and as shown in FIG. 1. In this left-hand tilt-latch configuration, the latch bolt 32 is oriented such that the incline surface 58 faces generally towards its respective guide rail 16 when the sash window 12 is in a position as shown in FIG. 1. As the window 12 is rotated from this position to one within the master frame 14, the incline surface 58 impacts and is acted upon by the guide rail 16 to slide the latch bolt 32 from an extended position to a retracted position to allow the latch bolt to pass by the guide rail 16. Once the inclined surface 58 passes the guide rail 16, the spring 36 returns the latch bolt 32 to its extended position and the normal surface 60 interferingly engages and opposes a surface of the guide rail 16 to maintain the window 12 in a slidable position within the master frame 14.

The tilt-latch 10 as shown and described, may also be configured to operate as a right-handed tilt-latch 10 to be located at the upper right corner of the window 12. This configuration is shown in FIG. 8. In this configuration, the inclined surface 58 will generally face its respective guide rail 16 when used in the upper right corner of the window 12 and the window is in the position shown in FIG. 1. In operation, it functions identically to the functioning of the left-hand tilt-latch 10 previously described. To rotate the sash window 12 from within the master frame 14 to without, an operator substantially simultaneously slides the actuator 34 of both the left-hand tilt-latch 10 and right-hand tilt-latch 10 away from their respective guide rails 16. This moves each latch bolt 32 to its retracted position disengaging the normal surface 60 of the nose 56 of each tilt-latch 10 from its respective guide rail 16 thus permitting rotation of the window 12.

A single latch bolt 32 may be assembled in the housing 30 as described in either a first position as shown in FIG. 3 (left-handed) or a second position as shown in FIG. 8 (right-handed). To achieve the second or right-handed orientation or position as shown in FIG. 8, the latch bolt 32 is inserted into the housing in an orientation having been rotated 180 degrees about its longitudinal axis as compared to its orientation as shown in FIG. 3. Generally, the latch bolt 32 is flipped upside down to change from the first, left-hand position to the second, right-hand position. The ability of the latch bolt 32 to be operably positioned within the housing 30 in either position or orientation is due to the previously described and shown symmetrical and generally mirror-image structure of the latch bolt 32. In particular, because the upper portion 61 and lower portion 63 of the bolt body 57 are generally symmetrical and mirror-images of one another, as shown in FIG. 5 and described above, the latch bolt 32 may be operably positioned within the chamber 38 in either the first (left-handed) or second (right-handed) orientations. Thus, it is understood that FIG. 3 and FIG. 8 show the identical tilt-latch 10 components, namely, the housing 30, the latch bolt 32, the actuator 34 and the spring 36. The latch bolt 32 in FIG. 8 has merely been rotated to the second position. In either the first or second positions, the same actuator 34 is connectable to the latch bolt 32.

It can be seen that the orientation of the inclined surface 58 with the latch bolt 32 in its right-handed position is generally opposite its orientation when the latch bolt 32 is in its left-handed position.

Also, the symmetrical nature of the front and rear cross-bars 68, 70, the front, medial and rear apertures, 72, 74, 76, the fingers 84, the rails 84 and the protrusion 88, permit connection between the actuator 34 and the latch bolt 32 in either a left-hand or right-hand tilt-latch configuration. Additionally, it can be seen that the latch bolt 32 is shaped to slide within the chamber 38 when it is in either orientation.

The ability of the single latch bolt 32 to be utilized in connection with either a left-handed tilt-latch 10 or a right-handed tilt-latch 10 provides several benefits. Among these, are that less tooling is needed to be able to supply tilt-latches 10 for both configurations. Also, a manufacturer or its customers are required to maintain less inventory and it becomes simpler to inventory tilt-latches 10 of the present invention. This is because a single tilt-latch 10 may serve the needs of both right-handed and left-handed tilt-latches 10. Also, damage to tilt-latches 10 during shipping may be reduced as they may be shipped fully assembled thereby reducing risk of damage to individual components.

It will be understood by those in the art, that actuators 34 and bolts 32 of various configurations can be utilized while remaining within the scope of the present invention.

Figure 9:
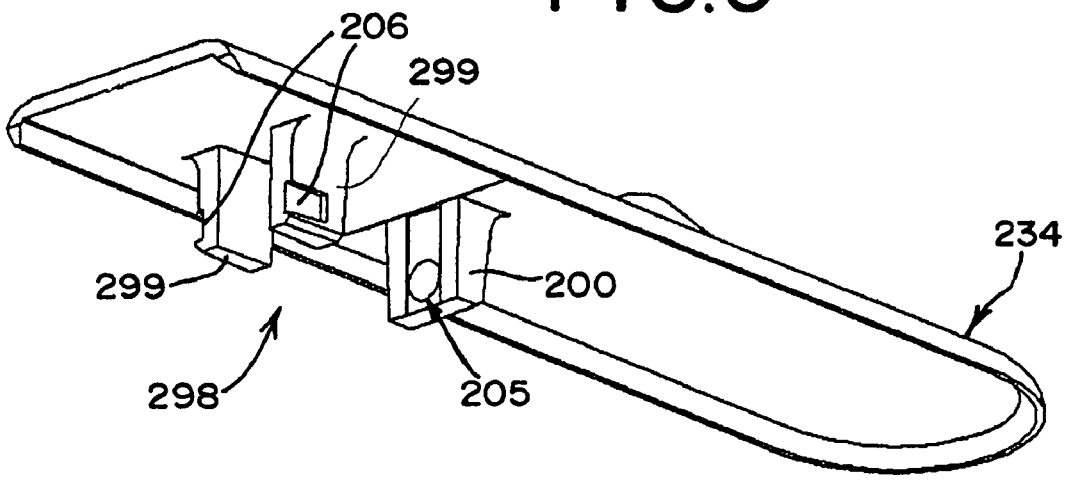
FIG. 9 is a perspective view of the underside of an alternative embodiment of an actuator for the tilt-latch.
Figure 10:
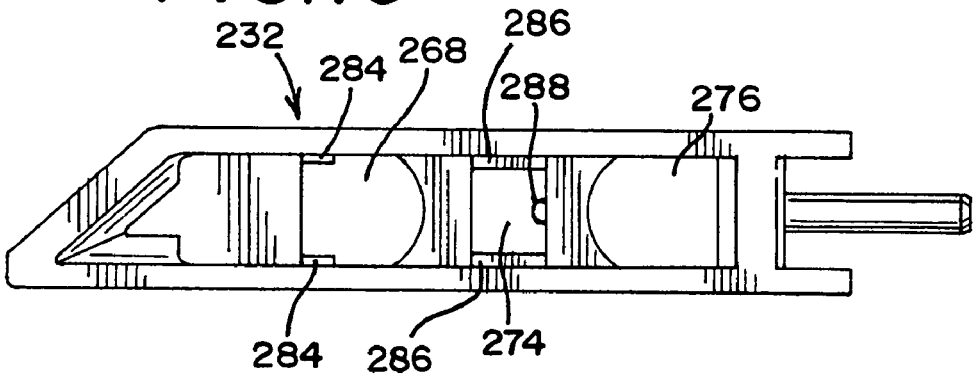
FIG. 10 is a plan view of an alternative embodiment of a latch bolt for use with the actuator of FIG. 9.

For instance, FIG. 9 shows an alternative actuator 234 for use with a latch bolt 232 depicted in FIG. 10. In the embodiment as shown in FIGS. 9 & 10, features similar to those of the previously described embodiments are referred to with similar reference numerals, but in the 200 designation range. The latch bolt 232 is generally similar to the previously described latch bolt 32. However, it has a protrusion 288 located in its medial aperture 274, rather than in its rear aperture 276. The latch bolt 232 also has a pair of fingers 284 located in its front aperture 268, similar to previously described embodiments. The latch bolt 234 further has a pair of rails 286 in the medial aperture 274.

The actuator 234 has a first post 298 and a second post 200. The first post 298 is comprised of a pair of legs 299, each leg 299 having a recess 206 thereon. The second post 200 includes a depression or hole 205. In an assembled state the front aperture 268 receives the first post 298 and the recesses 206 interferingly receive the fingers 284. The medial aperture 74 receives the second post 200 and the depression 205 interferingly receives the protrusion 288. Additionally, an actuator could be utilized including a single post similar to either the first post 298 or the second post 200 and adapted to be received by the front, medial or rear apertures 268, 274, 276.

Figure 11:
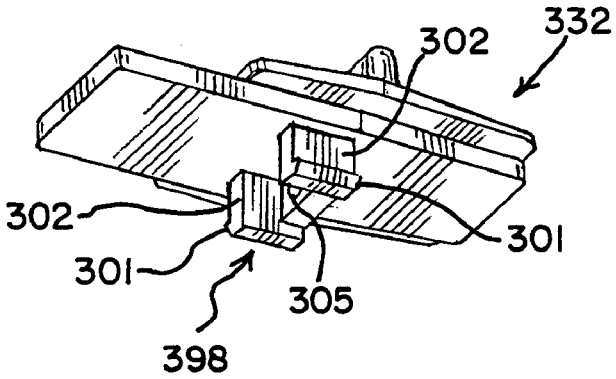
FIG. 11 is a perspective view of a further embodiment of an actuator for the tilt-latch.

A further embodiment of an actuator 332 is shown in FIG. 11. The actuator 332 of FIG. 11 includes a single post 398 adapted to be received by the medial aperture 274. The post 398 has a pair of legs 302. Each leg 302 includes a pair of lips 301 for engaging a respective rail 286 of the latch bolt 232. Also, the post 398 includes a hole or aperture 305 for receiving protrusion 288.

It is understood that the structure of the actuators 298, 398 (FIGS. 9 & 11) and latch bolt 232 (FIG. 10) allow the actuators 298, 392 to be connected to the latch 232, mounted in the housing 30, in either the first, left-handed position or the second, right handed position.

It is noted that the plurality of posts 98, 100, & 298, 200 described in connection with the actuator 34 and 234, respectively, provide for a superior and more durable connection between the actuator and the latch bolt. Additionally, having a plurality of posts spaced along the length of the actuator increases the ability of the actuator to resist any moments or twisting movements created between the actuator and the latch bolt that might otherwise generate twisting of or torsion of a single post, like the post 398 of the actuator 332, for example. Of course an actuator could be utilized having any of a wide variety of connecting means with the latch bolt and remain within the scope of the invention.

It is additionally noted that all of the above-described embodiments are equally adaptable to be made of various metals that are of sufficient strength and durability. That is, the housing, bolt and actuator of each of the above embodiments may be comprised of metal rather than plastic, or other suitable materials. One preferred metal is zinc. It is further understood that the tilt-latch 10 can include a combination of plastic and metal components.

While the specific embodiments have been illustrated and described, numerous modifications come to mind without significantly departing from the spirit of the invention and the scope of protection is only limited by the scope of the accompanying claims.

I claim:

1. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails, the latch bolt having a first surface wherein the latch bolt is capable of being operably positioned in the housing in a first position with the first surface facing upwards for a right-hand tilt-latch and second position with first surface facing downwards for a left-hand tilt-latch; and an actuator connected to the latch bolt when the latch bolt is positioned in one of the first position and the second position, wherein the latch bolt has a height and further comprises actuator connecting structure comprising a pair of opposed rails proximate a midpoint of the height and the actuator comprises a depending post having a pair of lips for releasably engaging a respective rail.

2. The tilt-latch of claim 1 wherein the latch bolt is substantially symmetrical about a plane occupying a longitudinal axis of the latch bolt.

3. The tilt-latch of claim 1 wherein the structure comprises a latch bolt body that is substantially symmetrical about a plane occupying a longitudinal axis of the latch bolt.

4. The tilt-latch of claim 3 wherein the latch bolt has a height and the plane is generally proximate a midpoint of the height.

5. The tilt-latch of claim 3 wherein the plane is generally parallel to a second plane generally defined by a cover of the housing.

6. The tilt-latch of claim 3 wherein the plane is generally perpendicular to a second plane generally defined by a cover of the housing.

7. The tilt-latch of claim 1 wherein the nose has an incline surface.

8. The tilt-latch of claim 7 wherein the orientation of the incline surface of the latch bolt when in the first position is generally opposite to the orientation of the incline surface of the latch bolt when in the second position.

9. The tilt-latch of claim 7 wherein the latch bolt is orientated in the first position for a right-hand latch, wherein the tilt-latch is adapted to be supported proximate a right-hand side of the top rail wherein the incline surface is adapted to impact the guide rail.

10. The tilt-latch of claim 7 wherein the latch bolt is orientated in the second position for a left-hand latch, wherein the tilt-latch is adapted to be supported proximate a left-hand side of the top rail wherein the incline surface is adapted to impact the guide rail.

11. The tilt-latch of claim 1 further comprising means for biasing the latch bolt through the outward end opening.

12. The tilt-latch of claim 11 wherein the biasing means comprises a spring having one end engaging the housing and another end engaging the latch bolt.

13. The tilt-latch of claim 12 wherein the latch bolt further comprises a spring post generally opposed to the nose, the spring being mounted to the spring post.

14. The tilt-latch of claim 1 wherein the housing further comprises a bottom wall defining a fastener hole adapted for receiving a fastener for securing the bottom wall to the top rail and wherein a slot of the latch bolt is generally aligned with the fastener hole.

15. The tilt-latch of claim 1 wherein the actuator connecting structure further comprises a pair of opposed fingers and the post comprises pair of recesses for engaging a respective finger.

16. The tilt-latch of claim 1 wherein the actuator connecting structure comprises a protrusion and the post comprises a depression for releasably engaging the protrusion.

17. The tilt-latch of claim 1 wherein a tab extends from the housing, the tab engaging the latch bolt in an extended position.

18. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having a bottom wall and an outward end opening; and a latch bolt disposed within the housing and slidable on the bottom wall, the latch bolt having a nose adapted for engaging a respective one of the guide rails, the latch bolt having a first portion and a second portion, the first portion being symmetrical to the second portion wherein the latch bolt is capable of being operable in the housing in a first position wherein the tilt-latch is a right-hand tilt-latch and a second position wherein the tilt-latch is a left-hand tilt-latch.

19. The tilt-latch of claim 18 further comprising an actuator connected to the latch bolt when the latch bolt is positioned in one of the first position and the second position.

20. The tilt-latch of claim 19 wherein the latch bolt has a height and further comprises actuator connecting structure proximate a midpoint of the height and the actuator comprises a depending post for releasably engaging the connecting structure.

21. The tilt-latch of claim 20 wherein the actuator connecting structure comprises a rail and the post comprises a lip for engaging the rail.

22. The tilt-latch of claim 20 wherein the actuator connecting structure comprises a pair of opposed rails and the post comprises a pair of lips for engaging a respective rail.

23. The tilt-latch of claim 22 wherein the actuator connecting structure further comprises a pair of opposed fingers and the post comprises a pair of recesses for engaging a respective finger.

24. The tilt-latch of claim 20 wherein the actuator connecting structure comprises a protrusion and the post comprises a depression for engaging the protrusion.

25. The tilt-latch of claim 18 wherein the first portion and the second portion are symmetrical in the direction of a height of the latch bolt.

26. The tilt-latch of claim 18 wherein the latch bolt is laterally symmetrical.

27. The tilt-latch of claim 18 wherein the nose has an incline surface.

28. The tilt-latch of claim 27 wherein the incline surface is generally normal to a plane generally defined by a cover of the housing.

29. The tilt-latch of claim 27 wherein the orientation of the incline surface of the latch bolt when in the first position is generally opposite to the orientation of the incline surface of the latch bolt when in the second position.

30. The tilt-latch of claim 27 wherein the latch bolt is orientated in the first position for a right-hand latch, wherein the tilt-latch is adapted to be supported proximate a right-hand side of the top rail wherein the incline surface is adapted to impact the guide rail.

31. The tilt-latch of claim 27 wherein the latch bolt is orientated in the second position for a left-hand latch, wherein the tilt-latch is adapted to be supported proximate a left-hand side of the top rail wherein the incline surface is adapted to impact the guide rail.

32. The tilt-latch of claim 18 further comprising means for biasing the latch bolt through the outward end opening.

33. The tilt-latch of claim 32 wherein the biasing means comprises a spring having one end engaging the housing and another end engaging the latch bolt.

34. The tilt-latch of claim 32 wherein the latch bolt further comprises a spring post generally opposite the nose, the spring being mounted to the spring post.

35. The tilt-latch of claim 18 wherein the housing further comprises a bottom wall defining a fastener hole adapted for receiving a fastener for securing the bottom wall to the top rail and wherein a slot of latch bolt is generally aligned with the fastener hole.

36. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having structure for retaining a latch bolt in the housing and an outward end opening;

the latch bolt disposed within the housing and having a nose having an inclined surface, the nose adapted for engaging a respective one of the guide rails, the latch bolt having a first surface, the latch bolt adapted to occupy a first position with the first surface facing upwards for a right-hand tilt latch and a second position with the first surface facing downwards for a left-hand tilt latch, wherein in the first position the incline surface is adapted to impact a respective guide rail when the housing is supported near a right-hand side of the top rail and wherein in the second position the incline surface is adapted to impact a respective guide rail when the housing is supported near a left-hand side of the top rail.

37. The tilt-latch of claim 36 further comprising an actuator connected to the latch bolt when the latch bolt is positioned in one of the first position and the second positions.

38. The tilt-latch of claim 37 wherein the latch bolt has a height and further comprises actuator connecting structure at a midpoint of the height and the actuator comprises a depending post for releasably engaging the connecting structure.

39. The tilt-latch of claim 36 wherein the incline surface is adapted to impact a respective guide rail when the window is rotated to a position secured within the master frame.

40. The tilt-latch of claim 36 wherein the latch bolt has a height and is symmetrical about a plane located generally at a midpoint of the height.

41. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing having an incline surface at a nose wherein the latch bolt is capable of being operably positioned in the housing in a first position for a right-hand tilt latch and a second position for a left-hand tilt latch, wherein the latch bolt in the second position is rotated generally 180 degrees from the latch bolt in the first position about a longitudinal axis of the latch bolt; and wherein the latch bolt has a height and further comprises an actuator connecting structure having a pair of opposed rails proximate a midpoint of the height.

42. The tilt-latch of claim 41 further comprising an actuator connected to the latch bolt when the latch bolt is positioned in one of the first position and the second position.

43. The latch bolt of claim 41 wherein the latch bolt is substantially symmetrical about a plane proximate a midpoint of the height.

44. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails, the latch bolt having connecting structure comprising a pair of opposed rails located on a plane through a longitudinal axis of the latch bolt, the plane being generally parallel to a cover plane defined by the cover, wherein the latch bolt is symmetrical along the plane through the opposed rails; and an actuator having a depending post having a pair of lips that releasably engage a respective rail.

45. The tilt-latch of claim 44 wherein the latch bolt is symmetrical about a plane generally at a midpoint of the height.

46. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover;

a latch bolt operably disposed within the housing and having a nose adapted for engaging a respective one of the guide rails, the latch bolt having a longitudinal axis and a slot defined by a bolt surface facing the nose, the surface being laterally symmetrical about a plane through the longitudinal axis, the latch bolt having connecting structure comprising a pair of opposed rails located on a plane through the longitudinal axis of the latch bolt; and an actuator connected to the latch bolt, the actuator having a depending post having a pair of lips for releasably engaging a respective rail;

wherein the post substantially abuts the bolt surface when the actuator is connected to the latch bolt.

47. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing having an aperture and a pair of opposing rails located proximate a midpoint of a height of the latch bolt; and an actuator with a depending post;

wherein the post is received by the aperture and engages the pair of rails to connect the actuator to the latch bolt in a first position for a right-hand tilt latch and a second position for a left-hand tilt latch, wherein the second position, the latch bolt is rotated about a longitudinal axis of the latch bolt generally 180 degrees from the first position.

48. A latch bolt for a tilt-latch comprising a housing with an outward end opening, an actuator having a depending post for connecting to the latch bolt and a spring for biasing the latch bolt through the outward end opening, the tilt-latch being adapted for use with a sash window disposed within opposed guide rails on a master frame, the sash window comprises a top rail, a base and two stiles connected together at their extremities, the tilt-latch adapted for releasably securing the sash window to the master frame, the latch bolt comprising:

a body adapted to be disposed within the housing, the body having a height;

a nose adapted to engage a respective one of the guide rails;

a slot defined in the body;

a pair of opposing rails located proximate a midpoint of the height of the body; and, wherein the latch bolt is symmetrical along a plane through the opposed rails.

49. The latch bolt of claim 48 wherein the latch bolt has a height and the bolt is generally symmetrical about a plane through the longitudinal axis in the direction of the height.

50. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening;

a latch bolt disposed within the housing and having a nose adapted for engaging a respective one of the guide rails, the latch bolt having an aperture and a pair of fingers and a protrusion located proximate a midpoint of a height of the latch bolt; and an actuator having a first depending post and a second depending post spaced along a length of the actuator, the first depending post having a pair of recesses and the second depending post having a depression, the actuator being connected to the latch bolt;

wherein the aperture receives the first depending post and the second depending post, each recess receives a respective finger and the depression receives the protrusion.

51. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening; and a latch bolt disposed within the housing and having a nose adapted for engaging a respective one of the guide rails, the latch bolt having an aperture and a pair of rails located proximate a midpoint of a height of the latch bolt, wherein the latch bolt is symmetrical along a plane through the pair of rails; and an actuator having a depending post having a pair of lips;

wherein the aperture receives the depending post and each lip releasably engages a respective rail to connect the actuator to the latch bolt.

* * * * *

UNITED STATES PATENT AND TRADEMARK OFFICE

CERTIFICATE OF CORRECTION

PATENT NO. : 7,171,784 B2
APPLICATION NO. : 10/411881
DATED : February 6, 2007
INVENTOR(S) : Mark B. Eenigenburg It is certified that error appears in the above-identified patent and that said Letters Patent is hereby corrected as shown below:

Claim 29, column 12, line 57, delete "claim 32" and insert -- claim 33 --

Signed and Sealed this

Twenty-ninth Day of April, 2008

JON W. DUDAS
*Director of the United States Patent and Trademark Office*